US007314247B1

(12) United States Patent
Chen et al.

(10) Patent No.: US 7,314,247 B1
(45) Date of Patent: Jan. 1, 2008

(54) FOLDING DEVICE FOR A HIGHCHAIR

(75) Inventors: Shun-Min Chen, Taipei (TW); Hong-Bin Xu, Taipei (TW)

(73) Assignee: Wonderland Nurserygoods Co., Ltd. (TW)

( * ) Notice: Subject to any disclaimer, the term of this patent is extended or adjusted under 35 U.S.C. 154(b) by 0 days.

(21) Appl. No.: 11/556,600

(22) Filed: Nov. 3, 2006

(30) Foreign Application Priority Data

Jun. 20, 2006 (CN) ..... 2006 0 120424

(51) Int. Cl.
*A47D 1/02* (2006.01)

(52) U.S. Cl. ..... 297/16.1; 16/321; 16/344

(58) Field of Classification Search ..... 297/16.1, 297/183.2, 183.3, 183.4, 354.12, 364, 369; 16/321, 324–329, 333–335, 343, 344
See application file for complete search history.

(56) References Cited

U.S. PATENT DOCUMENTS 5,052,076 A * 10/1991 Spaeth ..... 16/266
5,142,739 A * 9/1992 Lin ..... 16/326
5,364,137 A * 11/1994 Shimer ..... 297/327
5,507,550 A * 4/1996 Maloney ..... 297/153
5,707,104 A * 1/1998 Perego ..... 297/16.1
5,961,180 A * 10/1999 Greger et al. ..... 297/183.4
6,126,236 A * 10/2000 Wu ..... 297/325
6,347,830 B1 * 2/2002 Chen ..... 297/16.1
6,546,595 B2 * 4/2003 Huse ..... 16/326
7,052,403 B2 * 5/2006 Ransil et al. ..... 297/16.1
2004/0216277 A1 * 11/2004 Beaver ..... 16/324

FOREIGN PATENT DOCUMENTS

CN 2624737 Y 7/2004

OTHER PUBLICATIONS

Copies of pages 1 and 2 of the specification for the U.S. Appl. No. 11/556,600.

* cited by examiner

*Primary Examiner*—Peter R. Brown
(74) *Attorney, Agent, or Firm*—Ostrolenk, Faber, Gerb & Soffen, LLP

(57) ABSTRACT

A folding device for connecting legs of a highchair includes first and second folding members, a toothed wheel, and an actuator. The first folding member is formed with a positioning groove, and the second folding member is formed with a position limiting unit. The toothed wheel includes a wheel body that is disposed between the first and second folding members and that has a periphery provided with a primary tooth engaging the positioning groove. The primary tooth engages the position limiting unit to lock the second folding member from movement relative to the first folding member when the second folding member is at an expanded position. The actuator is operated to release the second folding member from the locking action of the toothed wheel when moving the second folding member back to a folded position.

12 Claims, 8 Drawing Sheets

FOLDING DEVICE FOR A HIGHCHAIR

CROSS-REFERENCE TO RELATED APPLICATION

This application claims priority of Chinese application no. 200620120424.2, filed on Jun. 20, 2006.

BACKGROUND OF THE INVENTION

1. Field of the Invention

The invention relates to a folding device, more particularly to a folding device for a highchair.

2. Description of the Related Art

Referring to FIGS. 1 to 3, a folding device for a highchair as disclosed in CN 2624737Y includes a plastic outer cap 10, a plastic inner cap 20 and an actuator 30. The outer cap 10 has a lower portion connected to a front leg of the highchair.

The actuator 30 is formed with a spring chamber 33, and is disposed between the outer and inner caps 10, 20. The outer cap 10 is provided with a button slot 12 to hold the actuator 30 and prevent the actuator 30 from displacing relative to the outer cap 10.

The inner cap 20 is provided with a first protrusion 21 and a second protrusion 22. The actuator 30 is provided with a first engaging notched portion 31 and a second engaging notched portion 32. A restoring spring 40 is disposed in the spring chamber 33 of the actuator 30. When the highchair is in an expanded state, the first engaging notched portion 31 of the actuator 30 is biased by the restoring spring 40 to abut against the first protrusion 21 of the inner cap 20.

When folding the highchair, the actuator 30 is pressed upward to disengage the first engaging notched portion 31 of the actuator 30 from the first protrusion 21 of the inner cap 20. At this time, the inner cap 20 can be pivoted relative to the outer cap 10 for folding.

When expanding the highchair, the actuator 30 is pressed upward once again to permit pivoting of the inner cap 20 in the opposite direction for expanding.

Since positioning in the folding device is achieved through the first and second protrusions 21, 22 of the inner cap 20 and the first and second engaging notched portions 31, 32 of the actuator 30, it is required to operate the actuator 30 when expanding or folding the highchair.

SUMMARY OF THE INVENTION

Therefore, the object of the present invention is to provide a folding device for a highchair that is easier to operate as compared to the aforementioned prior art.

Accordingly, a folding device of the present invention is adapted for interconnecting foldably first and second legs of a highchair. The folding device comprises a first folding member, a second folding member, a toothed wheel, a spring and an actuator.

The first folding member is adapted to be connected to the first leg and is formed with at least one positioning groove.

The second folding member is adapted to be connected to the second leg and is formed with a position limiting unit that has a first contact portion and a second contact portion adjacent to the first contact portion. The second contact portion forms a step with the first contact portion and is indented relative to the first contact portion.

The toothed wheel includes a wheel body that is disposed between the first and second folding members and that has a periphery provided with at least one primary tooth. A portion of the primary tooth is received in the positioning groove to arrest rotation of the wheel body relative to the first folding member.

The spring is disposed between the wheel body and the first folding member.

The actuator is disposed on one side of the wheel body opposite to the spring and is accessible externally of the second folding member.

The second folding member is rotatable relative to an assembly of the first folding member and the toothed wheel between folded and expanded positions.

The primary tooth of the wheel body abuts against the first contact portion of the position limiting unit when the second folding member is at the folded position.

Movement of the second folding member to the expanded position results in abutment of the primary tooth of the wheel body against the second contact portion of the position limiting unit.

The actuator is operable to move the primary tooth of the wheel body away from the second contact portion of the position limiting unit against urging action of the spring to permit movement of the second folding member from the expanded position back to the folded position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
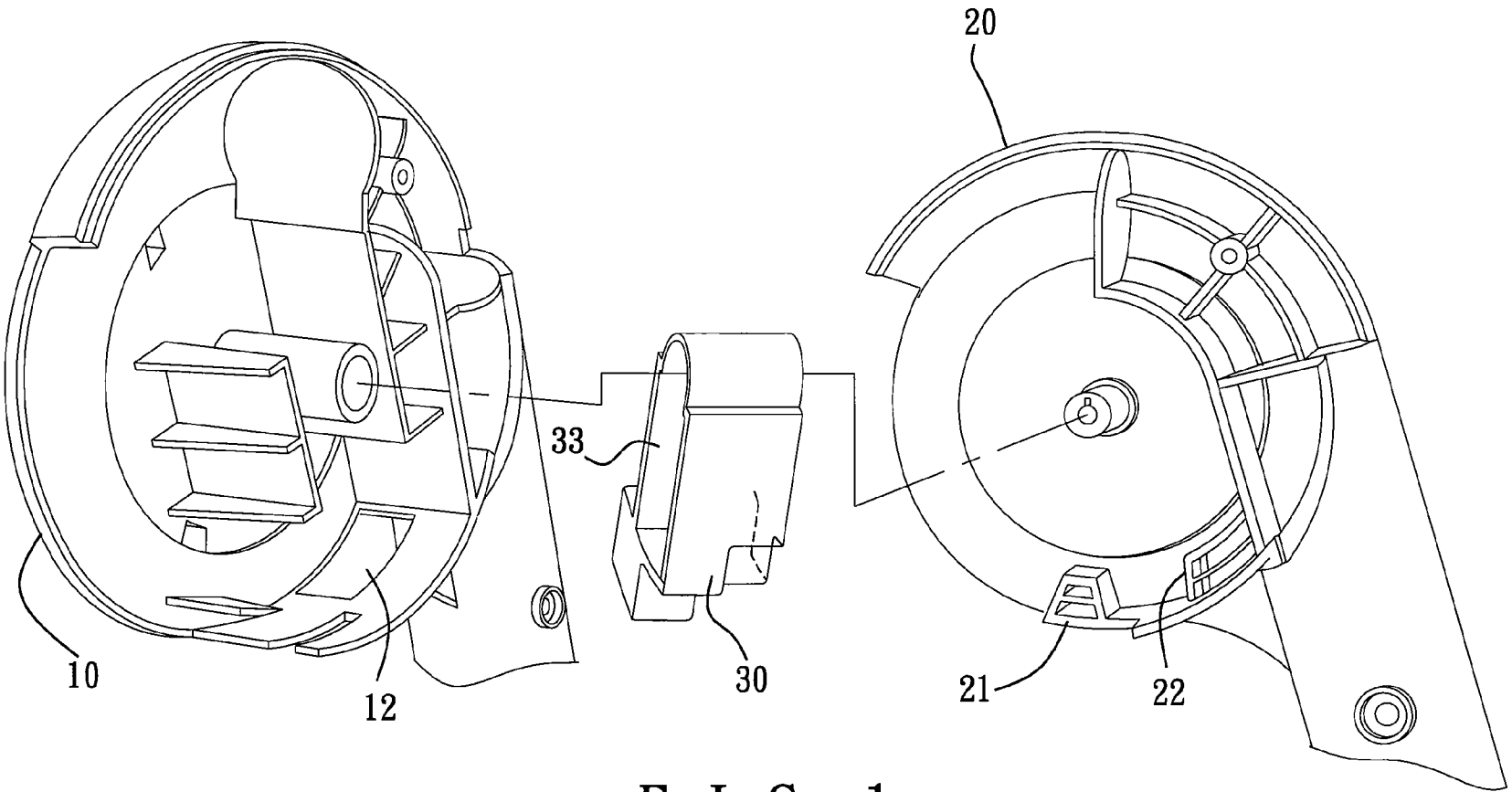
FIG. 1 PRIOR ART
FIG. 1 is a fragmentary exploded perspective view of a conventional folding device for a highchair.
Figure 2:
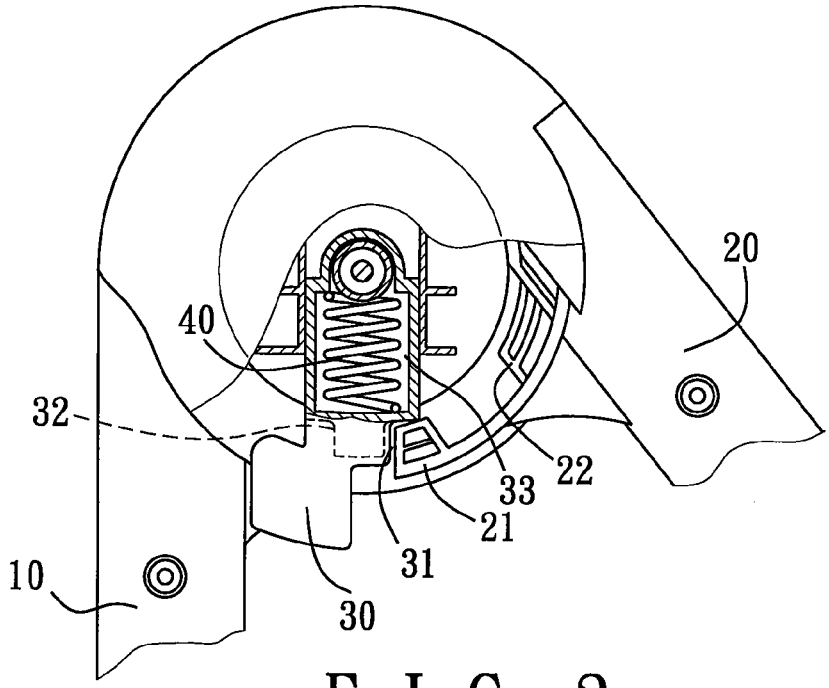
F I G. 2 PRIOR ART
FIG. 2 is a fragmentary assembled schematic partly sectional view of the conventional folding device in an expanded state.
Figure 3:
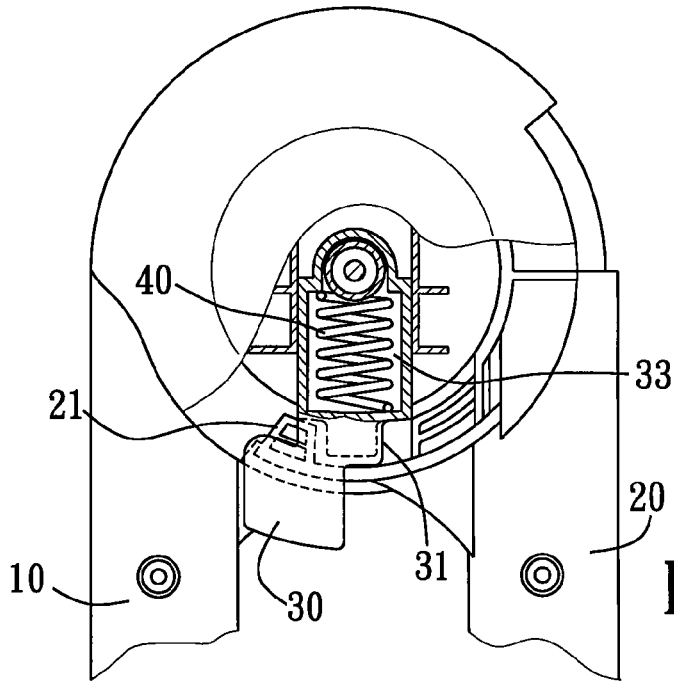
F I G. 3 PRIOR ART
FIG. 3 is a view similar to FIG. 2, but illustrating the conventional folding device in a folded state.
Figure 4:
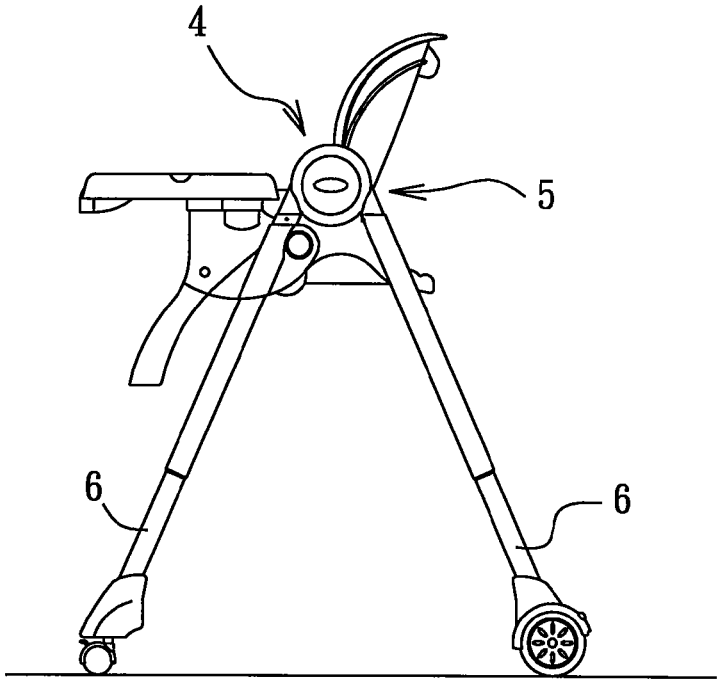
FIG. 4 is a schematic view of a highchair that incorporates the preferred embodiment of a folding device according to the present invention, the folding device being shown to be in an expanded state.
Figure 5:
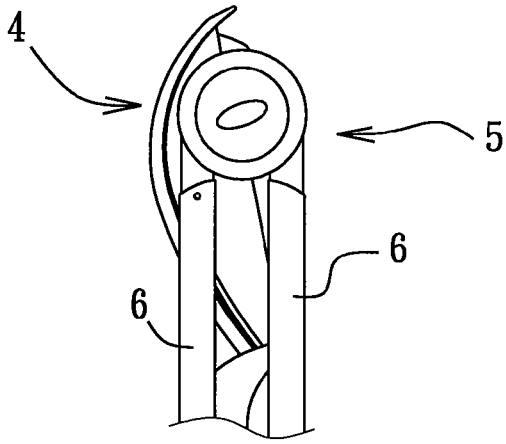
FIG. 5 is a fragmentary schematic view of the highchair to illustrate the preferred embodiment in a folded state.

FIGS. 4 and 5 illustrate the preferred embodiment of a folding device 5 according to the present invention, which is adapted for interconnecting foldably first and second legs 6, i.e., front and rear legs, on a same side of a seat member 4 of a highchair such that the first and second legs 6 can be converted between folded and expanded states. The first and second legs 6 form an angle therebetween when in the expanded state, and are close to each other when in the folded state.

Figure 6:
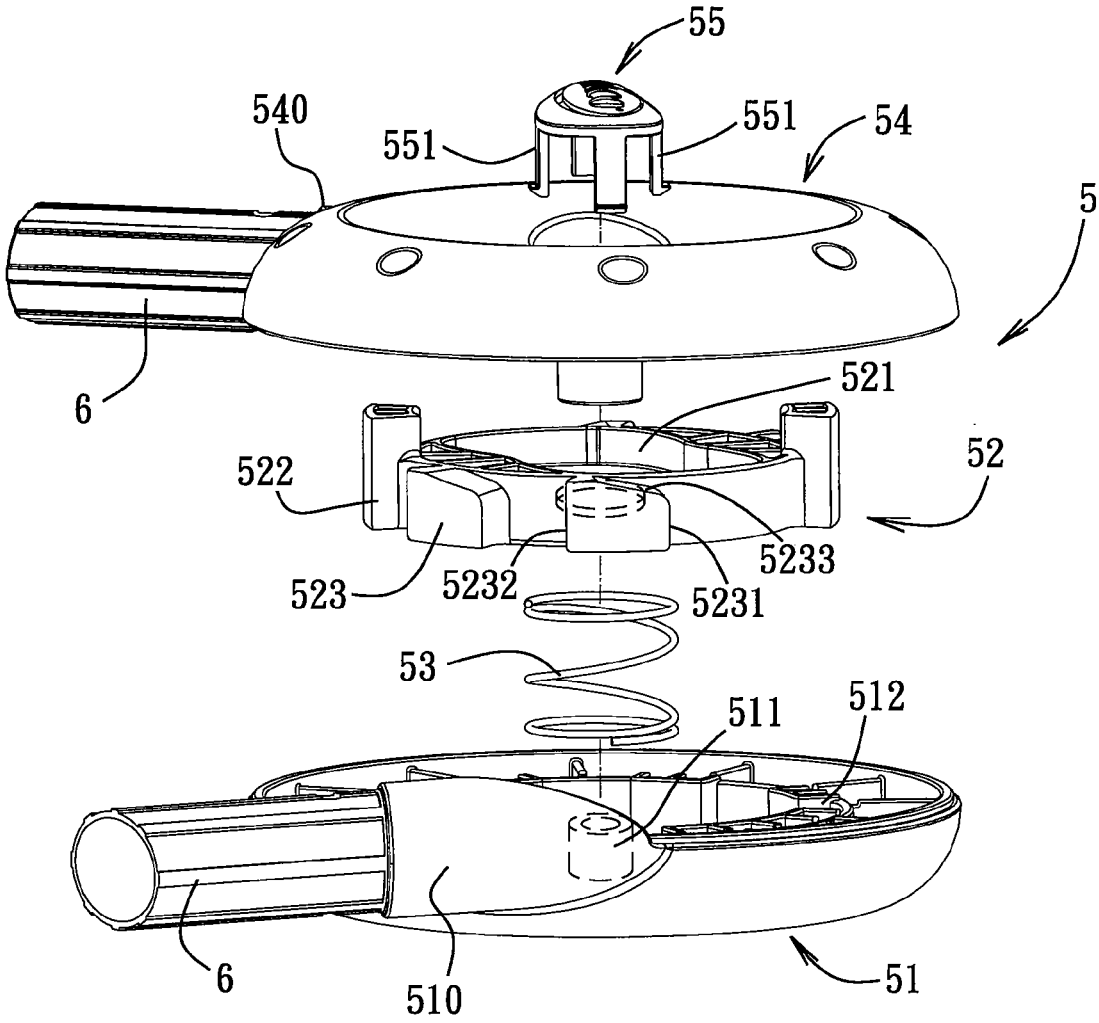
FIG. 6 is an exploded perspective view of the preferred embodiment.
Figure 7:
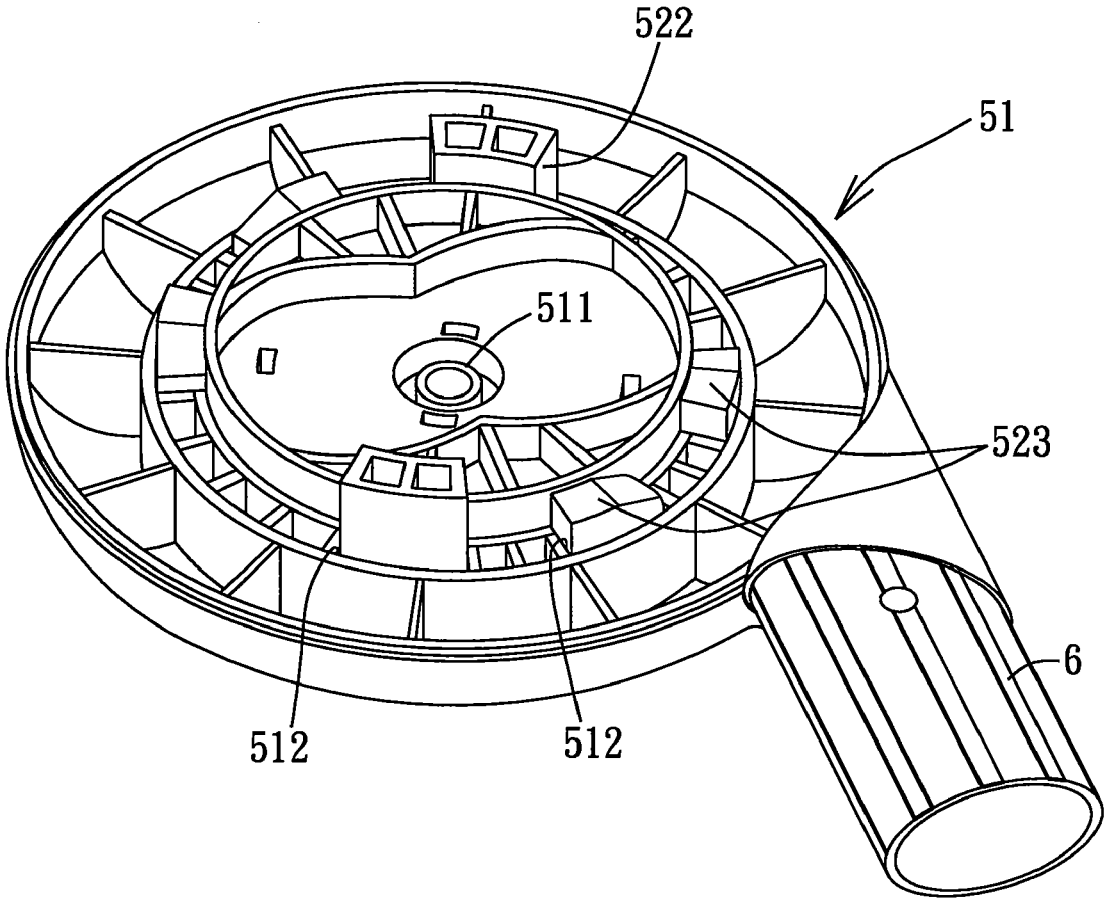
FIG. 7 is a perspective view to illustrate a first folding member of the preferred embodiment.
Figure 8:
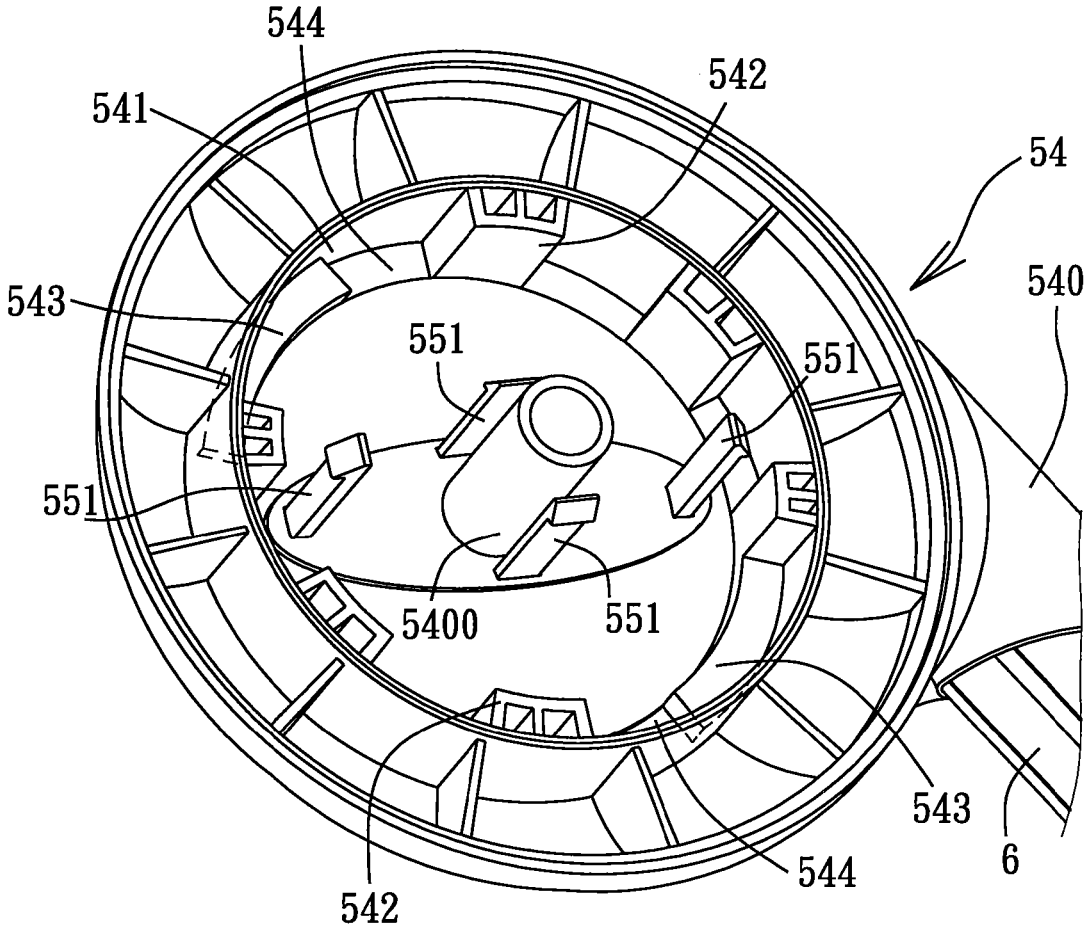
FIG. 8 is a perspective view to illustrate a second folding member of the preferred embodiment.

Referring to FIGS. 6, 7 and 8, the folding device 5 comprises a first folding member 51, a second folding member 54, a toothed wheel 52, a spring 53 and an actuator 55.

The first folding member 51 has a coupling seat 510 that extends from a periphery thereof along a tangential direction and that is adapted to be connected to the first leg 6, and an inner side formed with a central axle 511 and six angularly spaced apart positioning grooves 512 disposed around the central axle 511.

The second folding member 54 has a coupling seat 540 that extends from a periphery thereof along a tangential direction and that is adapted to be connected to the second leg 6, and an inner side that is formed with a central sleeve 5400 to be sleeved on the central axle 511 of the first folding member 51 to interconnect pivotally the first and second folding members 51, 54. The second folding member 54 is further formed with a pair of position limiting units 541 which are formed on an inner ring surface of an inner ring wall that surrounds the central sleeve 5400 and which are disposed at diametrically opposite positions relative to the central sleeve 5400. Each of the position limiting units 541 has a first contact portion 543 and a second contact portion 544 adjacent to the first contact portion 543. The second contact portion 544 forms a step with the first contact portion 543 and is indented relative to the first contact portion 543. The second folding member 54 is further formed with six protrusions 542 which are angularly spaced apart from each other and which are formed on the inner ring surface of the inner ring wall. Each of the position limiting units 541 is disposed between a respective pair of the protrusions 542.

The toothed wheel 52 includes a wheel body 521 that is disposed between the first and second folding members 51, 54 and that has a periphery provided with a pair of primary teeth 522 disposed at diametrically opposite positions. The periphery of the wheel body 521 is further provided with four angularly spaced apart secondary teeth 523 symmetrically disposed between the primary teeth 522. The height of each of the secondary teeth 523 is shorter than that of each of the primary teeth 522. A portion of each of the primary and secondary teeth 522, 523 is received in a respective one of the positioning grooves 512 to arrest rotation of the wheel body 521 relative to the central axle 511 of the first folding member 51. However, the wheel body 521 is movable relative to the first folding member 51 along the central axle 511, which passes through the wheel body 521 and which serves as a wheel axis. The primary teeth 522 are associated operably and respectively with the position limiting units 541 in a manner to be described hereinafter. Each of the secondary teeth 523 has first and second lateral sides 5231, 5232 and an inclined end surface 5233 interconnecting the first and second lateral sides 5231, 5232 and configuring the first lateral side 5231 to be shorter than the second lateral side 5232. Each of the secondary teeth 523 is associated operably with a corresponding adjacent pair of the protrusions 542 in a manner to be described hereinafter.

The spring 53 is sleeved on the central sleeve 5400 and is disposed between the wheel body 521 and the first folding member 51. The spring 53 biases the toothed wheel 52 away from the first folding member 51 and toward the second folding member 54.

Figure 9:
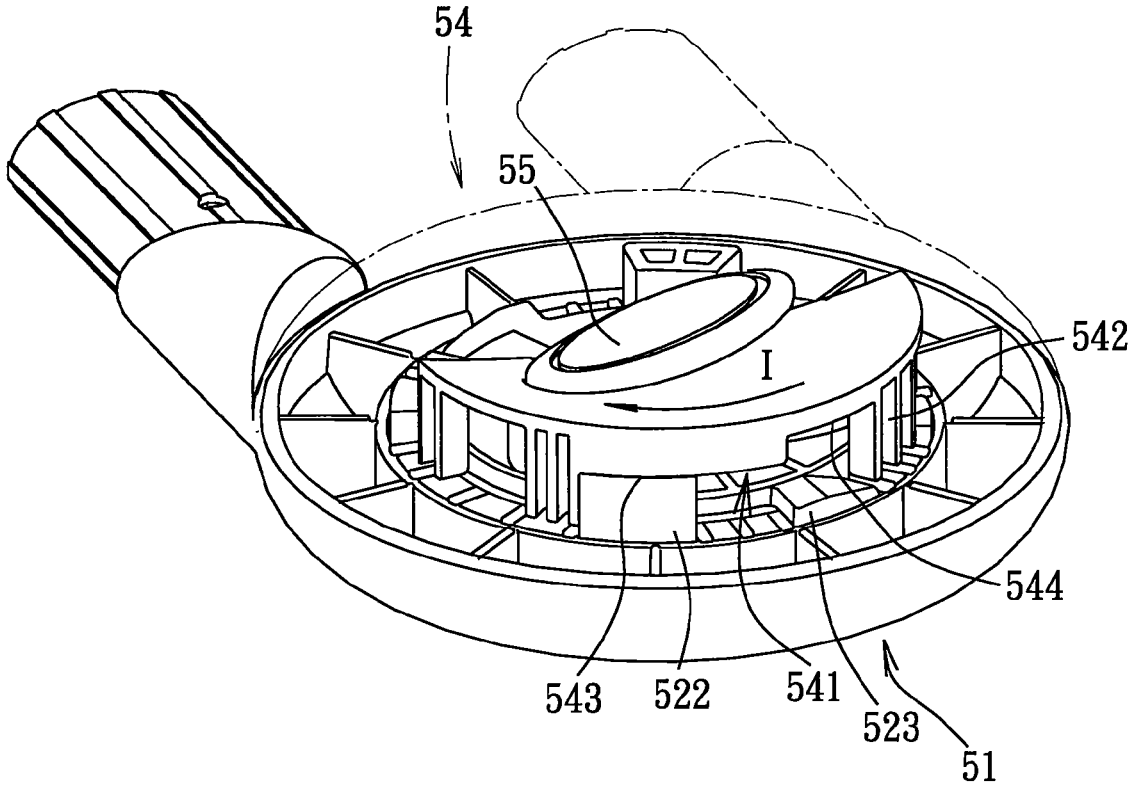
FIG. 9 is a fragmentary perspective view of the preferred embodiment to illustrate relationship among a position limiting unit and primary and secondary teeth when the folding device is folded.
Figure 10:
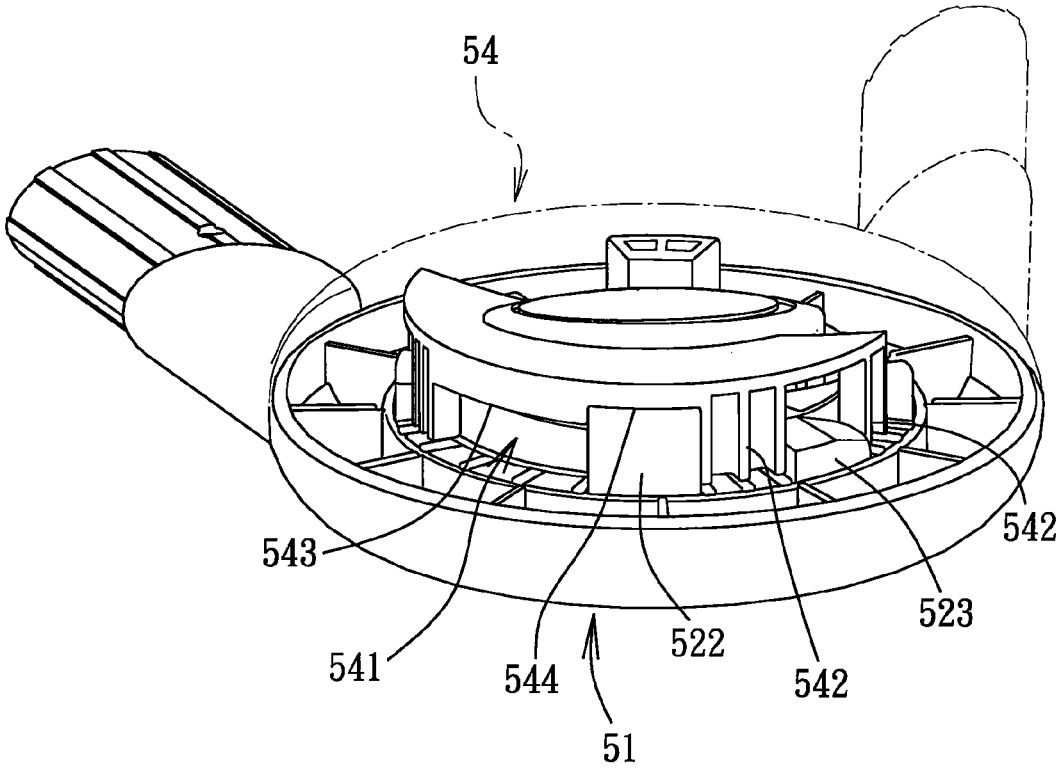
FIG. 10 is a view similar to FIG. 9, but illustrating the relationship among the position limiting unit and the primary and secondary teeth when the folding device is expanded.

The second folding member 54 is rotatable relative to an assembly of the first folding member 51 and the toothed wheel 52 between folded and expanded positions that correspond respectively to the folded and expanded states of the first and second legs 6. As shown in FIG. 9, when the second folding member 54 is at the folded position, i.e., the first and second legs 6 are at the folded state, an end face of each of the primary teeth 522 of the wheel body 521 abuts against the first contact portion 543 of the respective position limiting unit 541, and each of the primary teeth 522 further abuts against one of the protrusions 542 disposed adjacent to the first contact portion 543. At this time, the second contact portion 544 of each of the position limiting units 541 is registered with one of the secondary teeth 523 of the wheel body 521, and another one of the protrusions 542 disposed adjacent to the second contact portion 544 is located near the first lateral side 5231 of the registered one of the secondary teeth 523 of the wheel body 521. When the second folding member 54 is moved relative to the first folding member 51 in the direction (I) shown in FIG. 9 about the wheel axis to the expanded position shown in FIG. 10 so as to convert the first and second legs 6 to the expanded state, said another one of the protrusions 542 slides along the inclined end surface 5233 of the adjacent secondary tooth 523 of the wheel body 521, thereby pressing the wheel body 521 toward the first folding member 51 and compressing the spring 53. When said another one of the protrusions 542 moves past the adjacent secondary tooth 523 of the wheel body 521 so as to be located near the second lateral side 5232 of the adjacent secondary tooth 523 of the wheel body 521, said another one of the protrusions 542 further abuts against one of the primary teeth 522 of the wheel body 521, and the end face of each of the primary teeth 522 of the wheel body 521 is registered with the second contact portion 544 of the respective position limiting unit 541. At this time, the spring 53 causes the toothed wheel 52 to move along the wheel axis toward the second folding member 54 to result in abutment of the end face of each of the primary teeth 522 of the wheel body 521 against the second contact portion 544 of the respective position limiting unit 541. As best shown in FIG. 10, when the second folding member 54 is at the expanded position, each primary tooth 522 is confined by the first contact portion 543 of the respective position limiting unit 541 and an adjacent one of the protrusions 542, and each secondary tooth 523 is confined by an adjacent pair of the protrusions 542. As a result, the second folding member 54 is unable to rotate relative to the wheel body 521 and the first folding member 51, thereby locking the second folding member 54 at the expanded position.

To move the second folding member 54 from the expanded position back to the folded position, the locking action of the toothed wheel 52 on the second folding member 54 must be released first. In this embodiment, the actuator 55 is mounted movably on the second folding member 54, has four posts 551 (see FIGS. 6 and 8) that extend into the second folding member 54 and that abut against one side of the wheel body 521 opposite to the spring 53, and is accessible externally of the second folding member 54. The actuator 55 is operable to move the wheel body 521 away from the second folding member 54 against urging action of the spring 53 to release the locking action of the toothed wheel 52 on the second folding member 54, i.e., to move the primary teeth 522 of the wheel body 521 away from the second contact portions 544 of the position limiting units 541 and to move the secondary teeth 523 away from the protrusions 542 so as not to obstruct movement of the protrusions 542 when the second folding member 54 is moved relative to the assembly of the first folding member 51 and the toothed wheel 52 in the direction opposite to the direction (I) in FIG. 9. The second folding member 54 is disposed at the folded position once the primary teeth 522 of the wheel body 521 abut against the first contact portions 543 of the position limiting units 541 and further abut against the protrusions 542 disposed adjacent to the first contact portions 543 of the position limiting units 541, and once the protrusions 542 disposed adjacent to the second contact portions 544 of the position limiting units 541 are located near the first lateral sides 5231 of the adjacent secondary teeth 523 of the wheel body 521.

In this embodiment, the positions and numbers of the primary and secondary teeth 522, 523 on the wheel body 521 were chosen to achieve balanced forces during conversion of the first and second legs 6 between the folded and expanded states. In another embodiment of this invention, the wheel body 521 may be provided with only one primary tooth 522 and one secondary tooth 523 that cooperate with one position limiting unit 541 and one protrusion 542 on the second folding member 54 in the aforementioned manner. In yet another embodiment of this invention, the wheel body 521 may be provided with only one primary tooth 522 that cooperates with one position limiting unit 541 formed with a step of the second folding member 54 to achieve the same result.

In sum, in the folding device 5 of this embodiment, positioning is achieved through the primary and secondary teeth 522, 523 on the wheel body 521 and the position limiting units 541 and the protrusions 542 on the second folding member 54. The actuator 55 is provided to release the second folding member 54 from the locking action of the toothed wheel 52 when moving the second folding member 54 from the expanded position to the folded position. However, in the folding device 5 of this invention, the second folding member 54 can be moved from the folded position back to the expanded position by simply pulling apart the first and second legs 6 without the need to operate the actuator 55.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A folding device adapted for interconnecting foldably first and second legs of a highchair, said folding device comprising:

a first folding member adapted to be connected to the first leg and formed with at least one positioning groove;

a second folding member adapted to be connected to the second leg and formed with a position limiting unit that has a first contact portion and a second contact portion adjacent to said first contact portion, said second contact portion forming a step with said first contact portion and being indented relative to said first contact portion;

a toothed wheel including a wheel body that is disposed between said first and second folding members and that has a periphery provided with at least one primary tooth, a portion of said primary tooth being received in said positioning groove to arrest rotation of said wheel body relative to said first folding member;

a spring disposed between said wheel body and said first folding member; and an actuator disposed on one side of said wheel body opposite to said spring and accessible externally of said second folding member;

said second folding member being rotatable relative to an assembly of said first folding member and said toothed wheel between a folded position, where said primary tooth of said wheel body abuts against said first contact portion of said position limiting unit, and an expanded position, where said primary tooth of said wheel body abuts against said second contact portion of said position limiting unit;

wherein said actuator is operable to move said primary tooth of said wheel body away from said second contact portion of said position limiting unit against urging action of said spring to permit movement of said second folding member from the expanded position back to the folded position.

2. The folding device as claimed in claim 1, wherein said wheel body is further provided with at least one secondary tooth, said second folding member having at least one protrusion that projects toward said first folding member, said protrusion being located near a first lateral side of said secondary tooth when said second folding member is disposed at the folded position, and being located near a second lateral side of said secondary tooth when said second folding member is disposed at the expanded position.

3. The folding device as claimed in claim 2, wherein said secondary tooth has an inclined end surface interconnecting said first and second lateral sides and configuring said first lateral side to be shorter than said second lateral side, said protrusion sliding along said inclined end surface when said second folding member is moved from the folded position to the expanded position.

4. The folding device as claimed in claim 1, wherein:

said wheel body is provided with a pair of said primary teeth that are disposed respectively at diametrically opposite positions on said periphery of said wheel body, and a plurality of angularly spaced apart said secondary teeth symmetrically provided between said primary teeth; and said first folding member is formed with a plurality of said positioning grooves that correspond in number to a total number of said primary and secondary teeth and that receive portions of said primary and secondary teeth, respectively.

5. The folding device as claimed in claim 4, wherein said second folding member has a plurality of protrusions that project toward said first folding member, each of said primary and secondary teeth being disposed between an adjacent pair of said protrusions when said second folding member is disposed at the folded position.

6. The folding device as claimed in claim 1, wherein said second folding member has a pair of protrusions that project toward said first folding member, said position limiting unit being disposed between said protrusions when said second folding member is disposed at the folded position.

7. A folding device adapted for interconnecting foldably first and second legs of a highchair, said folding device comprising:

a first folding member adapted to be connected to the first leg and formed with at least one positioning groove;

a second folding member adapted to be connected to the second leg and formed with a position limiting unit that has a first contact portion and a second contact portion adjacent to said first contact portion, said second contact portion forming a step with said first contact portion and being indented relative to said first contact portion; and a toothed wheel including a wheel body that is disposed between said first and second folding members and that has a periphery provided with at least one primary tooth, said wheel body being movable relative to said first folding member along a wheel axis, a portion of said primary tooth being received in said positioning groove to arrest rotation of said wheel body relative to said first folding member;

said second folding member being rotatable relative to an assembly of said first folding member and said toothed wheel between a folded position, where said primary tooth of said wheel body abuts against said first contact portion of said position limiting unit, and an expanded position, where said primary tooth of said wheel body abuts against said second contact portion of said position limiting unit.

8. The folding device as claimed in claim 7, wherein said second folding member has a pair of protrusions that project toward said first folding member, said position limiting unit being disposed between said protrusions when said second folding member is disposed at the folded position.

9. The folding device as claimed in claim 8, wherein said wheel body is further provided with at least one secondary tooth, one of said protrusions being located near a first lateral side of said secondary tooth when said second folding member is disposed at the folded position, and being moved so as to be located near a second lateral side of said secondary tooth when said second folding member is moved to the expanded position.

10. The folding device as claimed in claim 9, wherein said secondary tooth has an inclined end surface interconnecting said first and second lateral sides and configuring said first lateral side to be shorter than said second lateral side, said one of said protrusions sliding along said inclined end surface when said second folding member is moved from the folded position to the expanded position.

11. The folding device as claimed in claim 7, further comprising an actuator for moving said wheel body along the wheel axis.

12. The folding device as claimed in claim 7, further comprising a spring for biasing said wheel body toward said second folding member.

* * * * *